US007287657B1

(12) United States Patent
Rodriguez

(10) Patent No.: US 7,287,657 B1
(45) Date of Patent: Oct. 30, 2007

(54) TRIPLE SEAL DISPOSABLE BABY BOTTLES

(76) Inventor: Ernest L Rodriguez, 15736 Wedgeworth Dr., Hacienda Heights, CA (US) 91745-2762

( * ) Notice: Subject to any disclaimer, the term of this patent is extended or adjusted under 35 U.S.C. 154(b) by 115 days.

(21) Appl. No.: 11/091,791

(22) Filed: Mar. 28, 2005

(51) Int. Cl.
*A61J 9/08* (2006.01)
*A61J 11/04* (2006.01)

(52) U.S. Cl. ..... 215/11.1; 215/11.3; 215/11.6

(58) Field of Classification Search ..... 215/11.1, 215/11.6, 11.3
See application file for complete search history.

(56) References Cited

U.S. PATENT DOCUMENTS 2,885,104 A * 5/1959 Greenspan ..... 206/222
2,986,296 A * 5/1961 Bannister et al. ..... 215/11.1
3,146,904 A * 9/1964 Hansen et al. ..... 215/11.1
3,273,703 A * 9/1966 Stribley ..... 206/471
3,406,853 A * 10/1968 Mcleod ..... 215/11.3
3,477,603 A 11/1969 Koll
3,549,036 A * 12/1970 Ritsi ..... 215/11.6
3,782,578 A * 1/1974 Ballin ..... 215/256
3,952,897 A * 4/1976 Pickerell et al. ..... 215/11.6
4,676,386 A 6/1987 Phlaphongphanich
4,700,856 A * 10/1987 Campbell et al. ..... 215/11.3
4,706,827 A 11/1987 Cabernoch et al.
4,830,251 A 5/1989 Conrad
4,895,264 A * 1/1990 Phlaphongphanich ..... 215/11.1
4,986,428 A 1/1991 Signorini
5,096,077 A 3/1992 Odet et al.
5,150,801 A 9/1992 Held
5,411,155 A * 5/1995 Gordon et al. ..... 215/11.1
5,704,500 A 1/1998 Hoffmann et al.
5,881,893 A 3/1999 Manganiello
6,016,929 A 1/2000 Williams
6,138,847 A 10/2000 Johnson
6,286,697 B1 * 9/2001 Gasparini ..... 215/11.5
6,398,049 B1 * 6/2002 Cote ..... 215/11.6

FOREIGN PATENT DOCUMENTS

JP 2264660 A * 10/1990

* cited by examiner

*Primary Examiner*—Sue A. Weaver
(74) *Attorney, Agent, or Firm*—Michael I Kroll

(57) ABSTRACT

A baby bottle includes a bottle housing having an open end thereof for receiving a liquid therein. A nipple assembly is included having a securing collar, a stationary insert, and a nipple attached thereto for positioning at the open end of the bottle housing. The bottle further includes a cap having means for compressing the nipple positioned. The compressing means is positioned on an inner surface thereof. Upon a downward force being applied to the cap, a stationary insert holds the nipple upright. A compression cap presses down on the top and base of the nipple forming a triple airtight seal at the top, middle and base of the nipple for preserving the liquid in the bottle housing.

7 Claims, 12 Drawing Sheets

TRIPLE SEAL DISPOSABLE BABY BOTTLES

BACKGROUND OF THE INVENTION

1. Field of the Invention

The present invention relates generally to baby bottles and, more specifically, to a disposable baby bottle having a pre-filled bottle with a nipple assembly pressed on the open end of the bottle with the nipple assembly having a pop off cap for opening and sealing purposes. The bottle includes a plurality of concentric collar attachment rings positioned at the open end thereof. The nipple assembly may be pressed on or heat bonded within the collar attachment to seal the bottle. A sealing collar is provided on the nipple assembly having a base diameter smaller than collar attachment rings, whereby the sealing collar may be pressed on and then frictionally connected to form an integral part with the bottle. Additionally, a stationary insert provides means to hold the nipple in an upright position when the cap is pressed down over the nipple. A cap assembly is connected to a securing collar of the nipple assembly via a flange extending circumferentially therearound.

Together with a stationary insert holding the nipple upright, and the compression cap pressing down on the top and base of the nipple, a triple airtight seal is formed at the top, middle and base of the nipple. The seal is further reinforced when the lip of the compression cap presses down on the nipple flange during the capping process.

As an additional element the present invention provides for a textured material to be incorporated into the manufacture of a collar-like portion of the pop off cap providing means for easily removing the cap even with wet hands 2. Description of the Prior Art There are other disposable baby items. Typical of these is U.S. Pat. No. 3,477,603 issued to Koll on Nov. 11, 1969.

Another patent was issued to Phlaphongphanich on Jun. 30, 1987, as U.S. Pat. No. 4,676,386. Yet another U.S. Pat. No. 4,706,827 was issued to Cabernoch et al. on Nov. 17, 1987 and still yet another was issued on May 16, 1989 to Conrad as U.S. Pat. No. 4,830,251. Another patent was issued to Signorini on Jan. 22, 1991 as U.S. Pat. No. 4,986,428. Yet another U.S. Pat. No. 5,096,077 was issued to Odet et al. on Mar. 17, 1992. Another was issued to Held on Sep. 29, 1992 as U.S. Pat. No. 5,150,801 and still yet another was issued on Jan. 6, 1998 to Hoffman et al. as U.S. Pat. No. 5,704,500.

Another patent was issued to Mangeniello on Mar. 16, 1999 as U.S. Pat. No. 5,881,893. Yet another U.S. Pat. No. 6,016,929 was issued to Williams on Jan. 25, 2000. Another was issued to Johnson on Oct. 31, 2000 as U.S. Pat. No. 6,138,847.

While these disposable baby devices may be suitable for the purposes for which they were designed, they would not be as suitable for the purposes of the present invention, as hereinafter described.

U.S. Pat. No. 3,477,603

Inventor: Stanley J. Koll

Issued: Nov. 11, 1969

A completely sterile, infant formula package which is a self-contained unit comprising a container, nipple and overlying sealing cap which safeguards the container contents against contamination and undetected tampering. The cap is easily and quickly removed by means of the unaided hand causing the nipple to automatically assume an erect feeding position.

U.S. Pat. No. 4,676,386

Inventor: Vichai Phlaphonghanich

Issued: Jun. 30, 1987

Baby bottle nipple or pacifier having a mouth portion made of elastomer and a base portion made of semi-rigid thermoplastic polymer. The mouth portion is formed in a hot first mold and the mouth portion is transferred to relatively cold second mold in which the base portion is molded around it.

U.S. Pat. No. 2,711,586

Inventor: Cabemoch et al.

Issued: Nov. 17, 1987

A container such as a nursing container, and packaging arrangement are disclosed of the type employing a rigid outer sleeve or holder and a flexible inner container. The inner container is pre-filled and sterilized and attached to an access assembly such as a nipple assembly for dispensing the contents. The access assembly, in one embodiment, is attached to and closes one end of the sleeve. In another embodiment, the access assembly is enclosed by the outer sleeve, one end of which is frangibly removable to access the access assembly. A flexible sheet may also be provided to simultaneously seal the ends of a plurality of containers and join them together in an integral packaging arrangement.

U.S. Pat. No. 4,830,251

Inventor: George R. Conrad

Issued: May 16, 1989

A compact stackable bottle feeder which comprises a tamper evident cap which captures a nipple and a pop-up indicator to insure the integrity of the bottle is secured. Upon removal of the cap the tamper evident band remains on the bottle. The pop-up indicator is removed providing an opening in the cap in which the nipple is placed with the cap then used to secure the nipple to the bottle.

U.S. Pat. No. 4,986,428

Inventor: Alberto Signorini

Issued: Jan. 22, 1991

A disposable nurser comprising a flexible bottle that is removably inserted within a bottle holder so that the open end of the flexible bottle is folded over the top edge and down the exterior sides of the bottle holder. A countercap comprising a sleeve is slidably mounted around the bottle holder and is slid upward from the bottom of the bottle holder, over the open ends of the flexible bottle, and upward until it engages a stop means that prevents the countercap from moving further. A nipple holding cap having a nipple inserted therein is removably attached to the countercap so that the nipple is sealingly connected in fluid flow relationship with the flexible bottle.

U.S. Pat. No. 5,096,077

Inventor: Philippe Odet et al.

Issued: Mar. 17, 1992

A stoppering device non-removably attached to the flanged neck of a container has a base (8) projecting beyond the neck of the container, with at least two arcuate surface sections extending from the base and disposed along a circle having a diameter slightly greater than that of the outer surface of the flanged neck (5). Each arcuate surface section (16) is extended on at least one of its sides in the circumferential direction by a locking foot (17). Each foot is integral with the arcuate surface at the end of the section opposite to the base (8) and is inclined inward from the end integral with the arcuate surface section (16) to a free end of the foot located toward the base (8). Each foot abuts the flanged neck (5) and holds the stoppering device securely onto the container.

U.S. Pat. No. 5,150,801

Inventor: Wolfgang Held

Issued: Sep. 29, 1992

A baby bottle having a neck with a mouth, and a nipple with a horizontal flange, supported by an annular cap which is detachably connectable to the neck. The annular cap is a portion of a hollow cylinder having a radially inwardly oriented flange that presses and seals the flange of the nipple against a face end of the mouth. The annular cap is connected with a joint to an approximately fork-shaped retaining body. The retaining body is capable of being detachably snapped onto a circumferential annular groove of an outer wall of the neck. The retaining body has legs that extend over more than 180.degree. of a neck circumference of the neck. A first side of the annular cap which is diametrically opposite from the joint has a detent protrusion facing inward that is detachably connectable to a detent recess of the neck.

U.S. Pat. No. 5,704,500

Inventor: David John Hoffman et al.

Issued: Jan. 6, 1998

A dispensing-sealing arrangement (10) is disclosed for a container (12) comprising a resiliently deformable dispensing apparatus typically in the form of a teat (14) connected about opening (16) of the container (12). The teat (14) is provided with an outlet (18) for dispensing matter contained in the container (12). Cap (20) is provided with a skirt (22) for insertion into the opening (16) for sealing the container (12). Sealing is achieved by the skirt (22) deforming the teat (14) in the manner so that a first portion (24) of the teat is sandwiched between the opening (16) and the skirt (22). The skirt (22) is configured so that sufficient pressure is applied to the teat (14) to ensure positive sealing between the teat and the first skirt (22). The skirt (22) is located in board of the periphery of, and depends from, upper wall (26) of cap (20). Inner surface (28) of skirt (22) together with the portion of the upper wall (26) bound by the skirt (22) defines a recess (32) for engaging a second portion (30) of the teat (14). The second portion (30) is located upstream of the first portion (24) and includes the outlet (18). Engagement of the second portion (30) in recess (32) is achieved by resilient deformation of the second portion against the inner surface (28) of the first skirt (22). When cap (20) is removed, it initially extends the teat (14) from the opening (16) due to the engagement of the second portion (30) in the recess (32).

U.S. Pat. No. 5,881,893

Inventor: Francis X. Manganiello

Issued: Mar. 16, 1999

A nipple for use with a baby bottle includes a flange having an upper surface, a lower surface, a cavity formed in the flange and through the lower surface, and a membrane formed in the flange above the cavity and through the upper surface. The cavity is contiguous with the membrane. The membrane has a perforation therethrough to form at least two resealable lips in the membrane. Preferably, the two resealable lips have an X-shape.

U.S. Pat. No. 6,016,929

Inventor: Stephen James Williams

Issued: Jan. 25, 2000

A baby's bottle comprises a container having a mouth, a teat for the mouth of the container and a cap for retaining the teat on the container, wherein the cap is non-removable from the container once attached thereto after filling of the container.

U.S. Pat. No. 6,138,847

Inventor: Russell Joe Johnson

Issued: Oct. 31, 2000

A disposable non-reusable baby bottle provides a container having a rigid flange at the container's open end, a nipple having a radially enlarged flange, and a snap ring which locks the nipple to the open end of the container. The nipple is invertible between a storage position wherein the nipple extends into the container and a ready-to-use position wherein the nipple is accessible to a nursing infant. The snap ring includes a snap ring sealing ridge which protrudes into the radially enlarged flange of the nipple to increase resistance to removal of the nipple following use. In an alternate embodiment, the container rigid flange includes a second sealing ridge which protrudes into the radially enlarged flange of the nipple to further increase resistance of the nipple to removal. A safety seal prevents contamination of the nipple by covering the nipple when the nipple is in the storage position.

SUMMARY OF THE PRESENT INVENTION

The present invention relates generally to baby bottles and, more specifically, to a disposable baby bottle having a pre-filled bottle with a nipple assembly pressed on the open end of the bottle with the nipple assembly having a pop off cap for opening and sealing purposes. The bottle includes a plurality of concentric collar attachment rings positioned at the open end thereof. The nipple assembly may be pressed on or heat bonded within the collar attachment to seal the bottle. A sealing collar is provided on the nipple assembly having a base diameter smaller than collar attachment rings, whereby the sealing collar may be pressed on and then frictionally connected to form an integral part with the bottle. Additionally, a stationary insert provides means to hold the nipple in an upright position when the cap is pressed down over the nipple. A cap assembly is connected to a securing collar of the nipple assembly via a flange extending circumferentially therearound. Together with the stationary insert holding the nipple upright, and the compression cap pressing down on the top and base of the nipple, a triple airtight seal is formed at the top, middle and base of the nipple. The seal is further reinforced when the lip of the compression cap presses down on the nipple flange during the capping process.

A primary object of the present invention is to provide a baby bottle that overcomes the shortcomings of the prior art.

Another, secondary object of the present invention is to provide a baby bottle that is already filled and is disposable.

Another object of the present invention is to provide a baby bottle that is pre-filled with a formula or beverage.

Yet another object of the present invention is to provide a beautifully designed, easy to open and reseal baby bottle.

Still yet another object of the present invention is to provide a baby bottle with a safe nipple assembly.

Another object of the present invention is to provide a baby bottle having a cap for sealing the nipple to the body of the bottle.

A further object of the present invention is to provide a baby bottle having a cap with a collar-like textured material to aid in the cap removal.

Yet another object of the present invention is to provide a baby bottle with a nipple assembly having a sealing collar that can be heat bonded onto a pre-filled bottle thereby becoming an integral part thereof.

Still yet another object of the present invention is to provide a baby bottle with a recessed securing ring where a pop off cap may be frictionally connected.

Another object of the present invention is to provide a baby bottle with a triple seal whereas a stationary insert holds the nipple upright and a compression cap presses down on the top and base of the nipple.

Yet another object of the present invention is to provide a baby bottle having a cover for the nipple formed from a plastic film to ensure that the nipple is sanitary.

Still yet another object of the present invention is to provide a baby bottle having a triple seal pop off cap that produces pressure upon the nipple to seal when the pop off cap is attached to the securing ring.

Yet another object of the present invention is that it is resealable.

Still yet another object of the present invention is to provide a baby bottle with a polymeric security seal to prevent tampering or contamination.

Still yet another object of the present invention is to provide a baby bottle that may be heat-sealed by applying sufficient heat to a sealing collar to melt the collar onto the bottle.

Yet another object of the present invention is to provide a baby bottle that can contain a beverage bag to prevent introduction of air to a beverage.

Additional objects of the present invention will appear as the description proceeds.

The present invention overcomes the shortcomings of the prior art by providing a disposable baby bottle that contains a bag of pre-filled formula or beverage that may be sealed and opened by means of a nipple assembly having a sealing collar, nipple, stationary insert and securing whereby a pop off cap may be attached to said securing ring. As the cap fits flush on the nipple no air pockets are trapped in-between them during the initial capping and resealing of the bottle.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Figure 1:
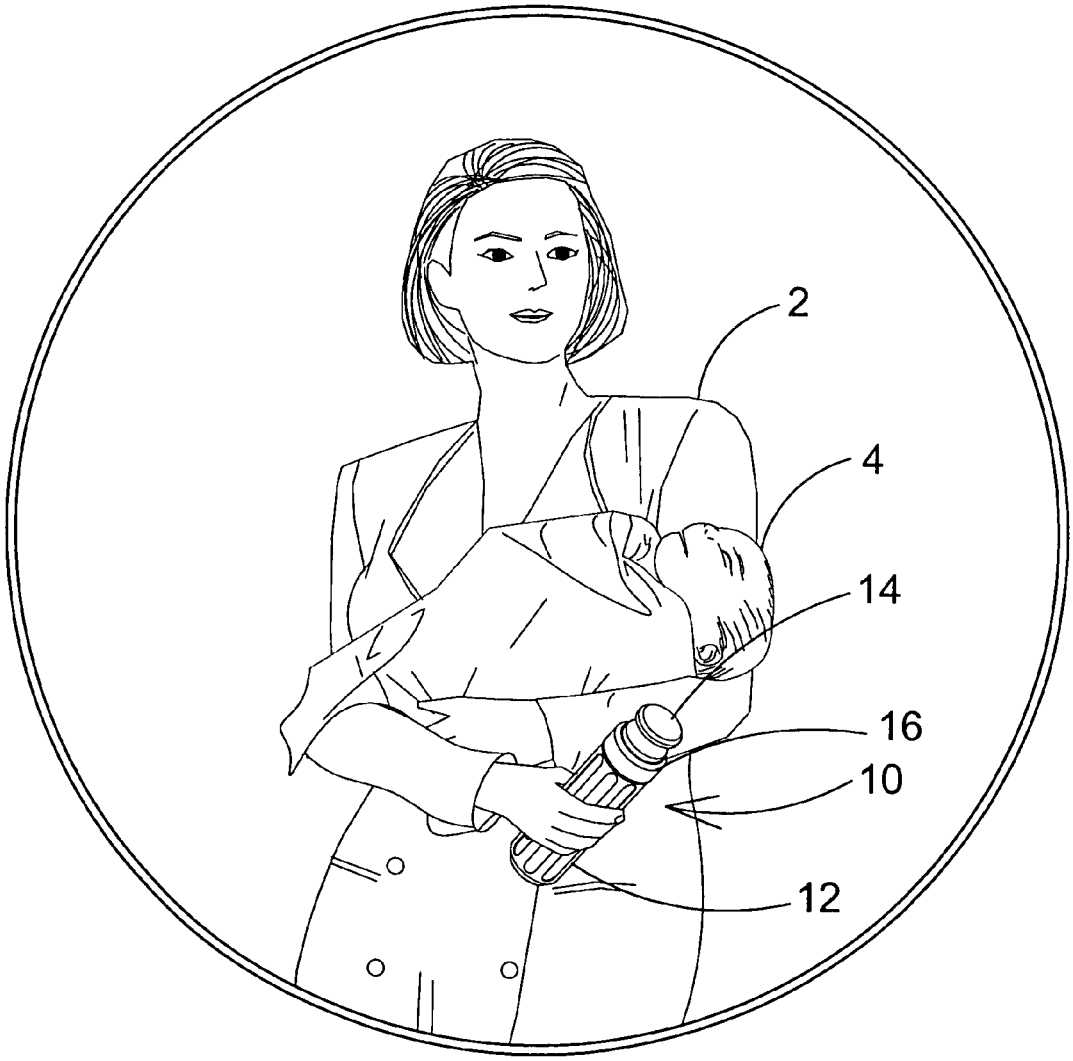
FIG. 1 is an illustrative view of the disposable baby bottle of the present invention.

FIG. 1 is an illustrative view of the disposable baby bottle of the present invention. The disposable baby bottle 10 of the present invention is shown being readied to give to an infant 4 by user 2. The user 2 may be a health care provider in a home or hospital setting as well as a parent. The disposable baby bottle 10 includes a bottle 12 for receiving liquid beverage therein such as juice or formula. The bottle 12 can be pre-packaged with the liquid beverage or, alternatively, the liquid beverage can be subsequently added thereto. As with conventional baby bottles, the disposable baby bottle of the present invention provides the liquid beverage to the infant via a nipple 20 as shown hereinafter with specific reference to FIGS. 3-12. However, the disposable baby bottle 10 differs in the application and securing of the nipple 20 to the bottle portion 12 of the present invention. The inventive manner in which the disposable baby bottle 10 is formed will be discussed hereinafter with respect to FIGS. 3-12.

The mother is preparing to feed the child with the present invention whereby the security seal and pop off cap are removed by the user to expose a nipple assembly wherein the infant 4 may have access to drink the prepared beverage or formula contained therein.

Figure 2:
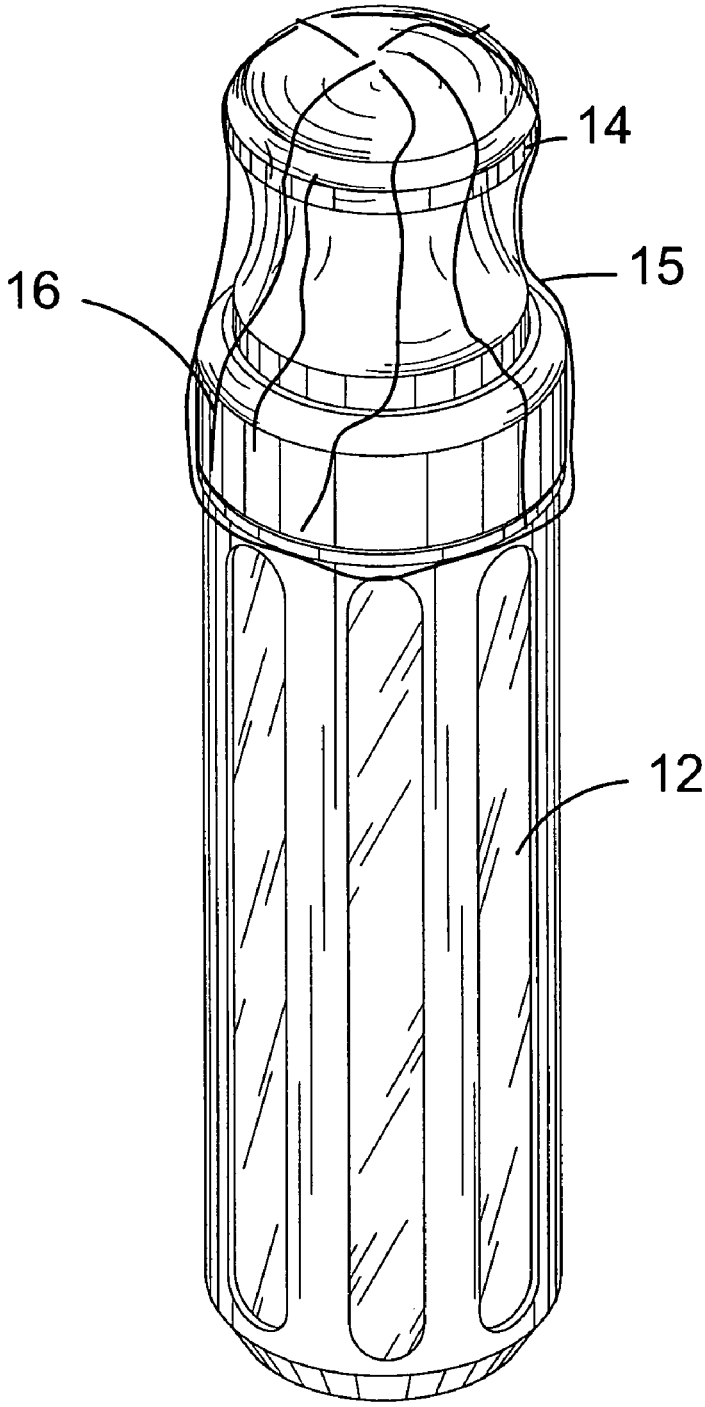
FIG. 2 is a perspective view of the disposable baby bottle of the present invention.

FIG. 2 is a perspective view of the disposable baby bottle of the present invention. The disposable baby bottle 10 of the present invention is shown being readied to give to an infant 4 by user 2. The user 2 may be a health care provider in a home or hospital setting as well as a parent. The disposable baby bottle 10 includes a bottle 12 for receiving liquid beverage therein such as juice or formula. The bottle 12 can be pre-packaged with the liquid beverage or, alternatively, the liquid beverage can be subsequently added thereto. As with conventional baby bottles, the disposable baby bottle of the present invention provides the liquid beverage to the infant via a nipple 20 as shown hereinafter with specific reference to FIGS. 3-12. However, the disposable baby bottle 10 differs in the application and securing of the nipple 20 to the bottle portion 12 of the present invention. The inventive manner in which the disposable baby bottle 10 is formed will be discussed hereinafter with respect to FIGS. 3-12.

Shown herein is the present invention a pre-filled bottle having a predetermined beverage or formula contained therein with a pop off cap and nipple assembly having an air tight seal 15 positioned over the cap 14. An additional sealing member is provided by a securing collar 16 to which the cap is removeably connected thereto. Upon the cap 14 being engaged with the securing collar, a pressure seal is formed thereby sealing the contents of the bottle therein. The sealing layer 15 is preferably a polymeric security seal which prevents tampering until its removal therefrom.

Figure 3:
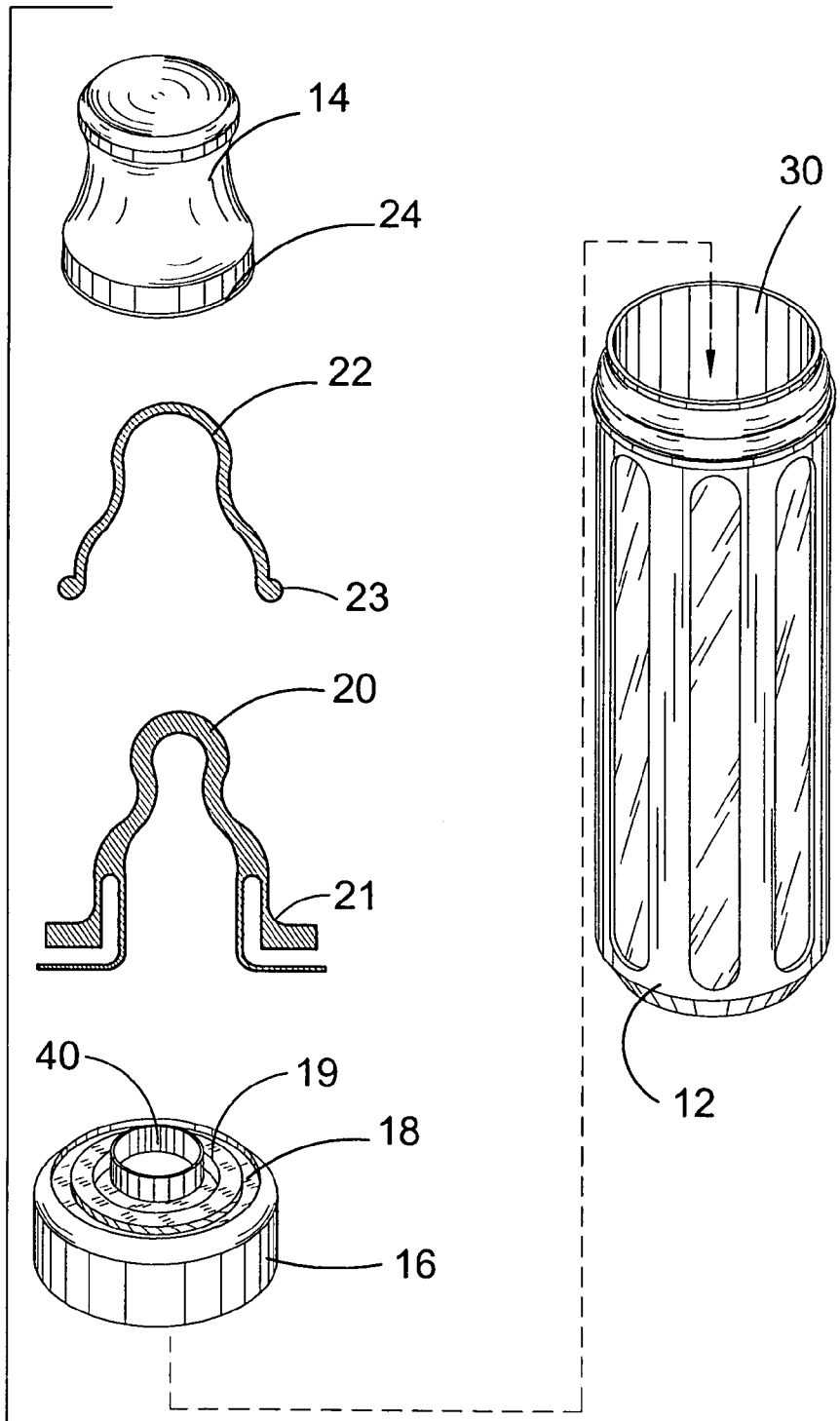
FIG. 3 is an exploded view of the disposable baby bottle of the present invention.

FIG. 3 is an exploded view of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The stationary insert 40 provides support of the nipple 20. The annular attachment ring 18 includes a recess 19 for securing a nipple 20 showed therein. The nipple includes a lip 20 which is received within the recess 19 for securing the nipple 20 thereto.

Figure 4:
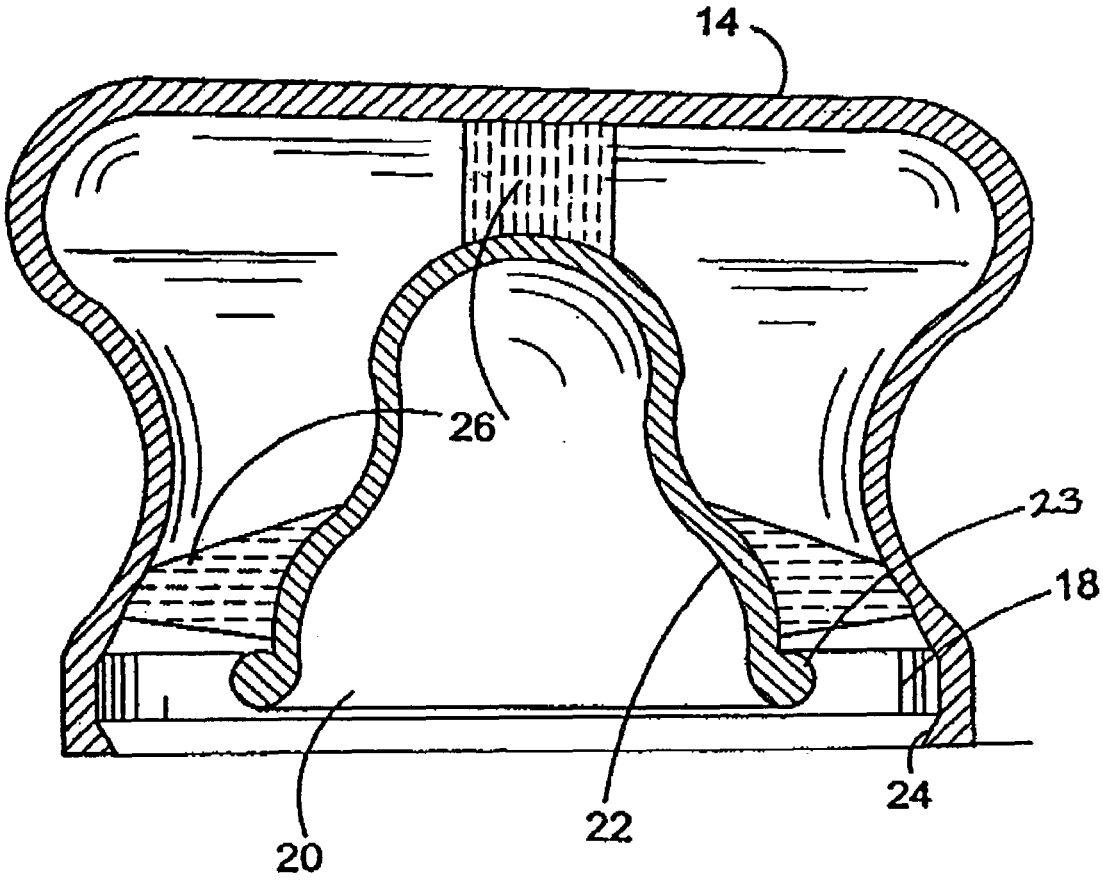
FIG. 4 is an enlarged sectional view of the outer cap of the disposable baby bottle of the present invention.

The cap 14 has an inner surface which bonding means 26 as shown in FIG. 4. A compression cap 22 is also positioned with the cap 14. The compression cap 22 has a shape substantially similar to the nipple 20. The compression cap 22 14 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

Furthermore, as will be discussed hereinafter with specific reference to FIGS. 8-10. The cap 14 is releaseably secured to the bottle by the same downward force applied when sealing the nipple 20 within the recess 19 of the annular attachment ring 18. The cap has mating flange 24 which is received within a mating recess 25 of the securing collar 16. The cap 14 is then removeable by jostling the cap 14 in order to release the mating flange 24 from the mating recess 25. Thereafter the nipple 20 is revealed and the user 2 can give the bottle 10 to the infant 4 as shown in FIG. 1.

FIG. 4 is an enlarged sectional view of the outer cap of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto.

The cap 14 has an inner surface which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

As shown herein each respective bonding means are positioned so as to transfer all the force applied to the cap to the compression cap 22 thereby causing the nipple 20 to be sealed within the recess 19 of the annular ring attachment 18 of the securing ring 16. The bonding means 26 are connected to both the inner surface of the cap 14 and the outer surface of the compression cap 22 by a bonding agent thereby maintaining the compression cap 22 in the desired position to ensure an air-tight seal with the bottle 12 when a downward force is applied to the cap 14.

Figure 5:
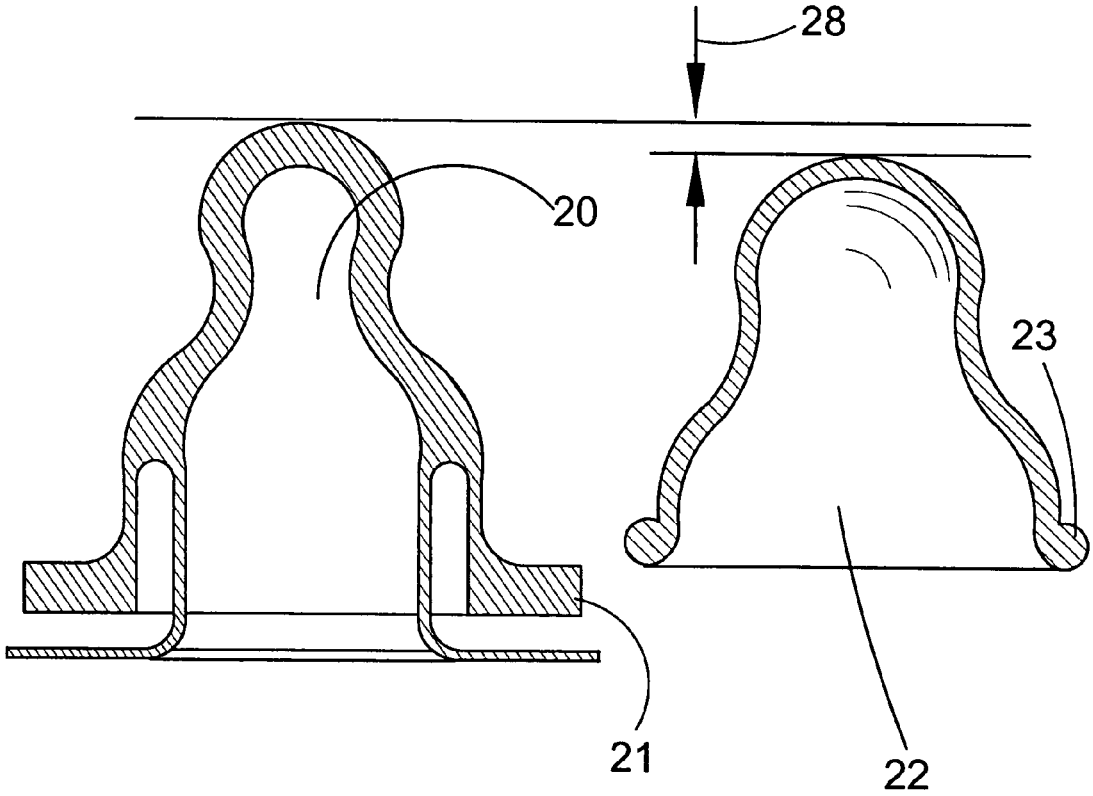
FIG. 5 is a cross-sectional view of the nipple and interior compression cap of the disposable baby bottle of the present invention.

FIG. 5 is a cross-sectional view of the nipple and interior compression cap of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto. The cap 14 has an inner surface which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

The compression cap 22 and the nipple 20 are substantially the same shape and have a height difference illustrated by the arrow labeled with reference numeral 28. The height difference 28 allows the compression lip 23 of the compression cap to rest atop the lip 21 of the nipple 20. The compression lip 23 extends circumferentially around a base of the compression cap 22. The compression lip 23 is preferably formed from a semi-rigid material for applying the downward force to the lip 21 thereby the lip 21 within the recess 19.

Figure 6:
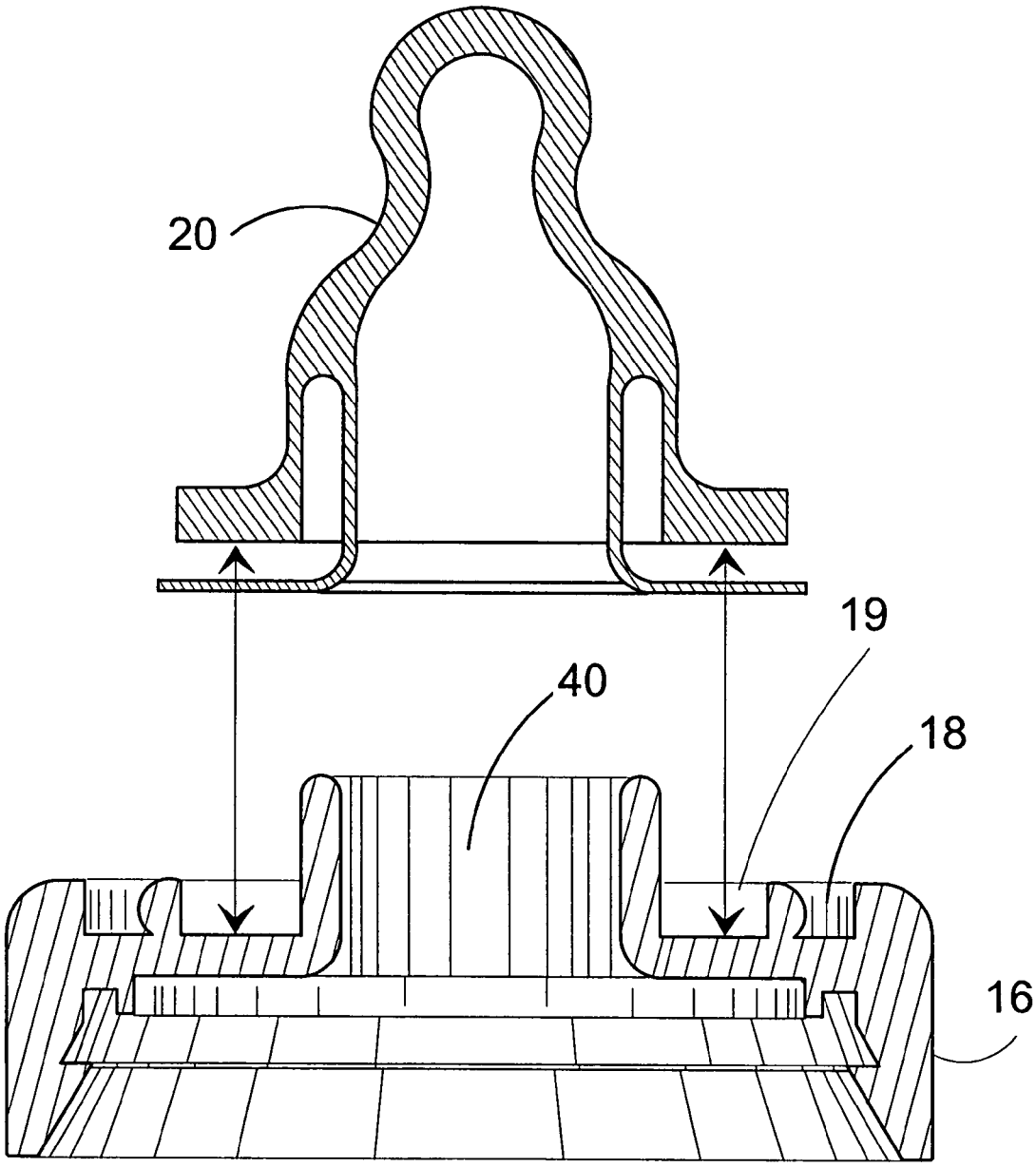
FIG. 6 is an exploded sectional view of the nipple and securing collar of the disposable baby bottle of the present invention.

FIG. 6 is an exploded sectional view of the nipple and securing collar of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto.

The cap 14 an inner she which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. The stationary insert 40 ensures the nipple 20 remains upright when force is applied. This applied force causes the nipple 20 to be pressure sealed to the annular ring 18 of the securing ring 16.

Figure 7:
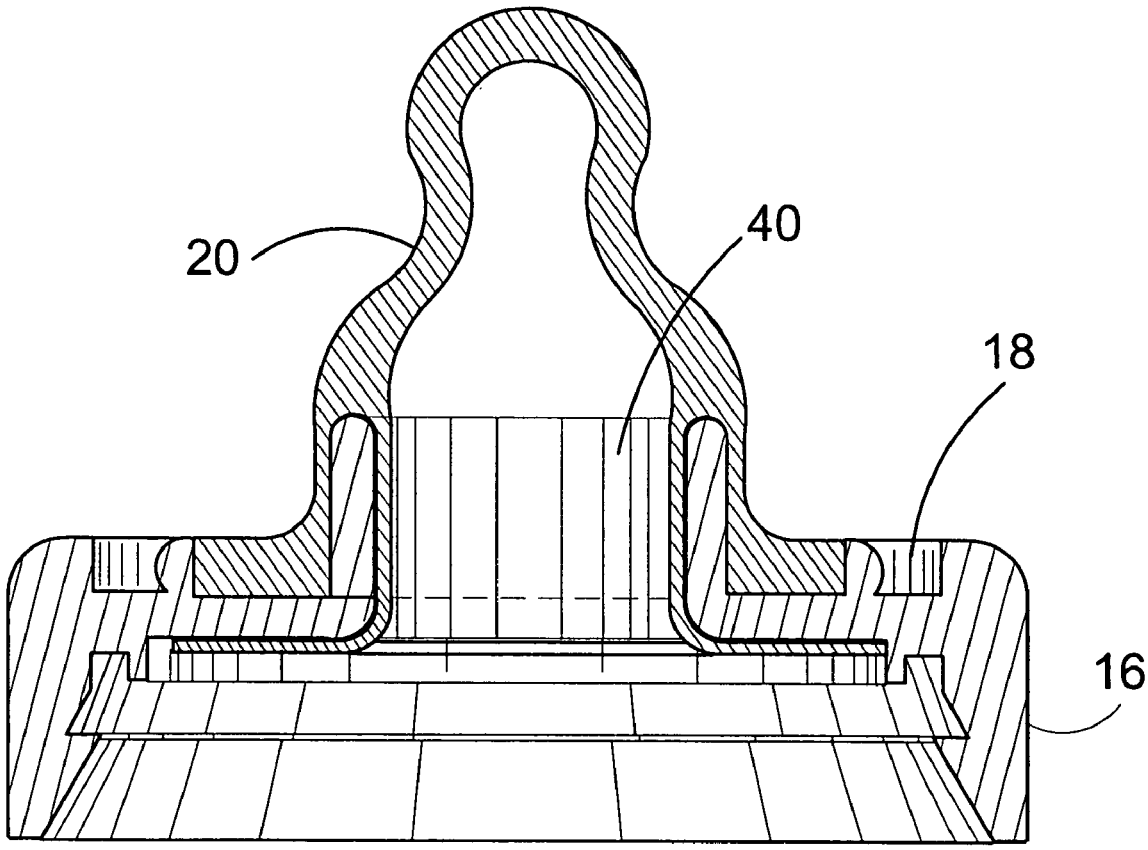
FIG. 7 is a cross-sectional view of the nipple and securing collar of the disposable baby bottle of the present invention.

FIG. 7 is a cross-sectional view of the nipple and securing collar of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto. The stationary insert 40 ensures the nipple 20 remains upright when force is applied.

The cap 14 has an inner surface which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

As illustrated in FIGS. 6 and 7, the securing collar 16 has an annular, inwardly extending flange with a vertical annular wall (stationary insert 40) to engage an L-shaped annular space between an upper flange 21 and a lower spaced flange of the nipple, thereby securing nipple 20 to collar 16, the compression lip 23 engaging the ledge (upper flange 21) of the nipple for compressing the ledge to form an air tight seal.

Figure 8:
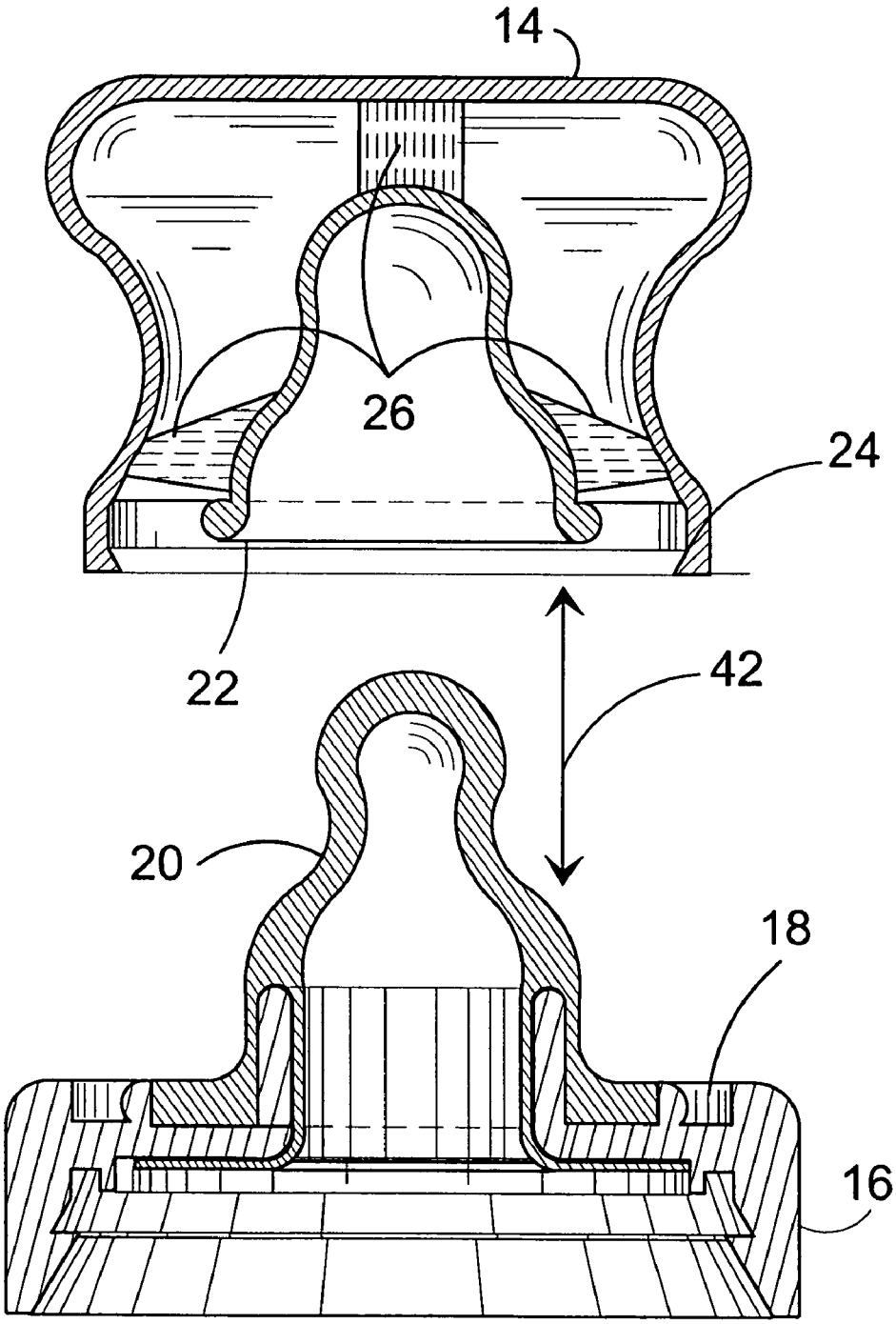
FIG. 8 is an exploded sectional view of the nipple and cap assembly of the disposable baby bottle of the present invention.

FIG. 8 is an exploded sectional view of the nipple and cap assembly of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto.

The cap 14 has an inner surface which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

The cap 14 is shown in Figure moving in a direction illustrated by the arrow labeled with reference numeral 42. The cap 14 is lowered onto the nipple 20 and the securing ng 18. The nipple 20 is received within the compression cap 22 of the cap 14. As a downward force is applied to the top side of the cap 14, the bonding means 26 transfer the force to the compression lip 23 of the compression cap 22. The force is further transferred from the compression lip 23 to the lip 21 of the nipple 20 thereby securing the lip 21 in the recess 19 of the annular attachment ring 18. The cap 14 can then be removed from the nipple assembly to reveal the nipple 20 secured thereto.

Figure 9:
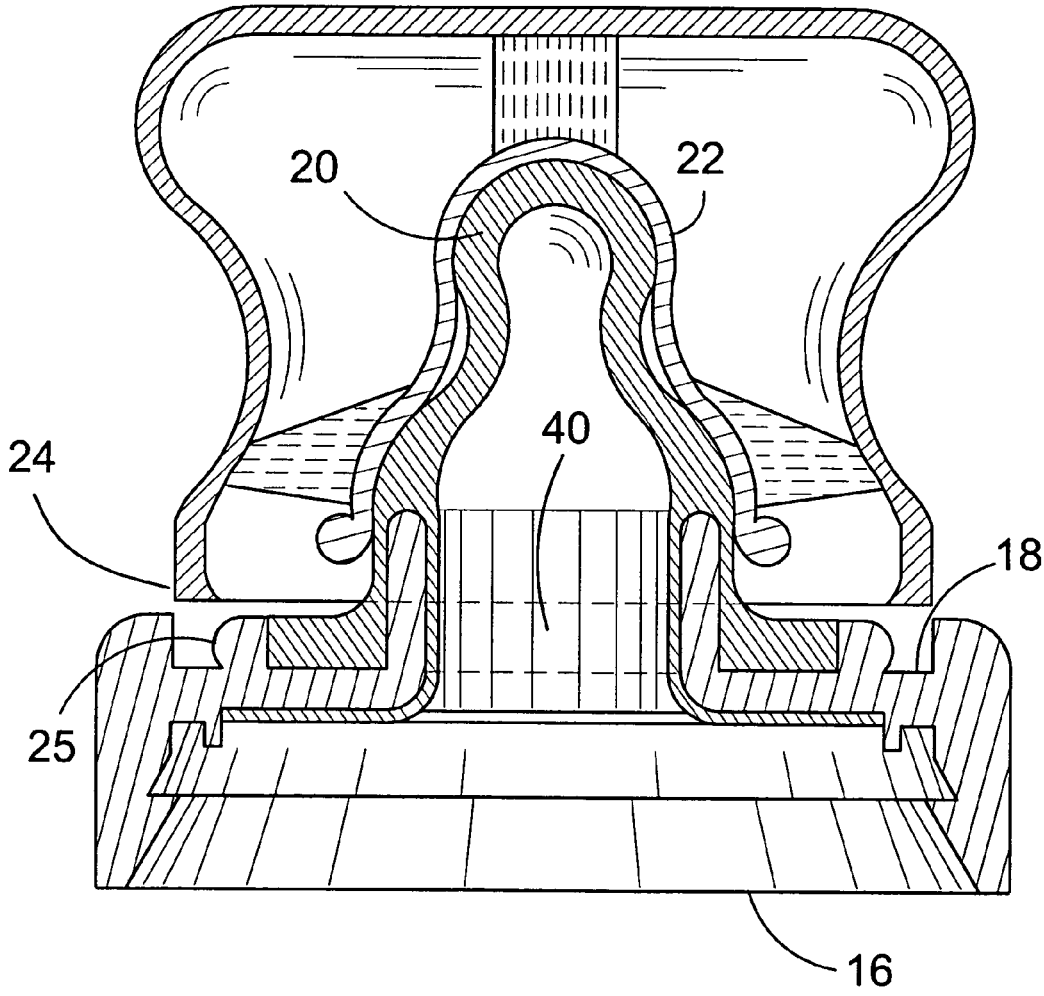
FIG. 9 is a cross-sectional view of the nipple and cap assembly of the disposable baby bottle of the present invention.

FIG. 9 is a cross-sectional view of the nipple and cap assembly of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The stationary insert 40 ensures the nipple 20 remains upright when force is applied. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto.

The cap 14 has an inner surface which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

Shown herein is the manner in which the cap 14 is releasably secured to the securing collar 16 of the baby bottle 10 of the present invention. The cap 14 includes the mating flange 24 which extends circumferentially around a base thereof. The annular attachment ring 18 includes the mating recess 25. The matting recess 25 receives the mating flange 24 of the cap therein and releasably secures the cap 14 to the bottle 12.

Figure 10:
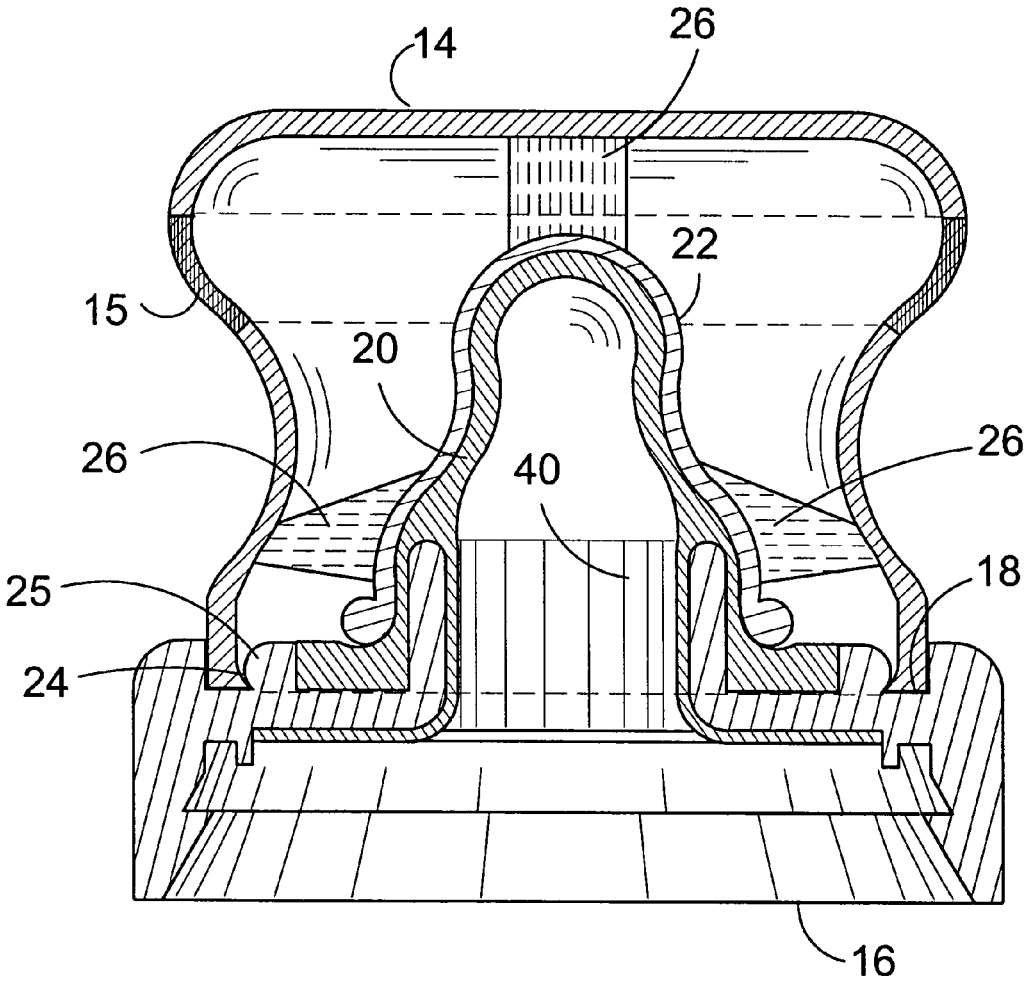
FIG. 10 is a cross-sectional view of the nipple and cap assembly of the disposable baby bottle of the present invention.

FIG. 10 is a cross-sectional view of the nipple and cap assembly of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The stationary insert 40 ensures the nipple 20 remains upright when force is applied. The annular attachment ring 18 includes a recess 19 for securing a nipple 20 showed therein. The nipple includes a lip 20 which is received within the recess 19 for securing the nipple 20 thereto.

The cap 14 has an inner surface with bonding means 26 as shown in FIG. 4 that may incorporate textured material 15 forming an integral part of cap 14. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

Shown is the cap 14 attached to the securing collar 16 by means of engagement of the mating flange 24 with the mating recess 25 of the securing ring 16. Once engaged, the nipple 20 will be compressed by the compression cap 22 creating an air tight seal. As pressure is being applied during the sealing process, the top part of the nipple is sealed off. Then the compressed neck and middle part of the nipple presses firmly against the cap forming a friction seal all around the middle part of the nipple. At the base of the nipple, the lower part of the compression cap 22 presses in against the nipple 20 and the stationary insert forming an air tight seal. The air tight seal is then further reinforced by the compression lip 23 pressing down on the lip 21 of the nipple 20.

Figure 11:
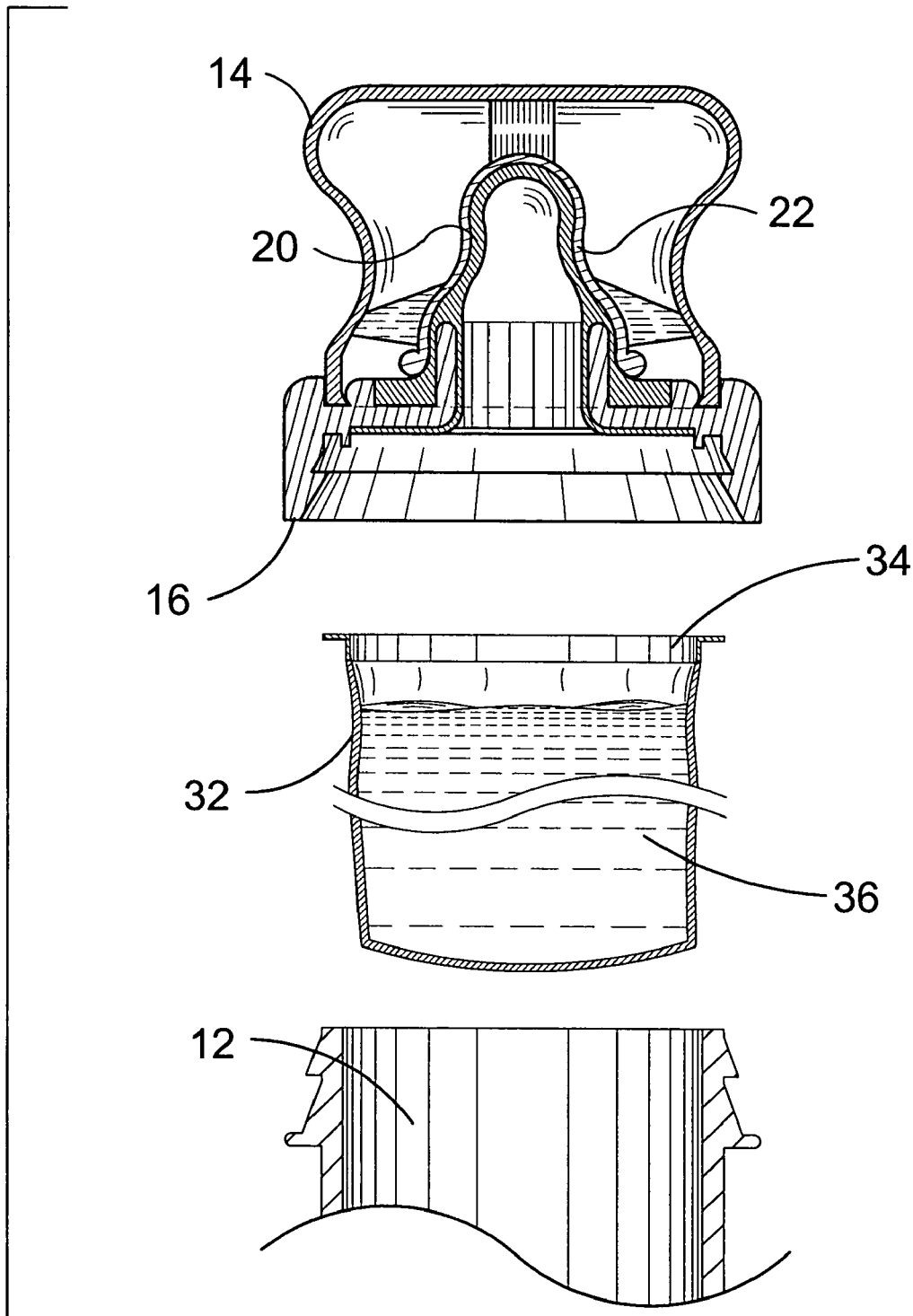
FIG. 11 is a cross-sectional view of the disposable baby bottle of the present invention.

FIG. 11 is a cross-sectional view of the disposable baby bottle of the present invention. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The annular attachment ring 18 includes a recess 19 for securing a nipple 20 showed therein. The nipple includes a lip 20 which is received within the recess 19 for securing the nipple 20 thereto.

The cap 14 has an inner surface which bonding 26 as shown in FIG. 4. A compression cap 22 is also positioned with the cap 14. The compression cap 22 has a shape substantially similar to the nipple 20. The compression cap 22 is connected to the cap 14 via the plurality bonding means 26 ending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

Shown herein, is the bottle portion 12 having a liner 32 which is selectively fillable with a beverage 36. The liner 32 has a suspension element 34 which is positioned at an open end thereof. The liner 32 received within the bottle portion 12 of the baby bottle 10 of the present invention. The suspension element 34 securely maintains the liner 32 with the beverage 36 within the bottle portion 12. Thereafter, as discussed above, the securing collar 16 is connected at the open end 30 of the bottle 12 thereby securing the liner 32 within the bottle 12. This allows for the liner to be removed and easily disposed of after the beverage 36 has been consumed.

Figure 12:
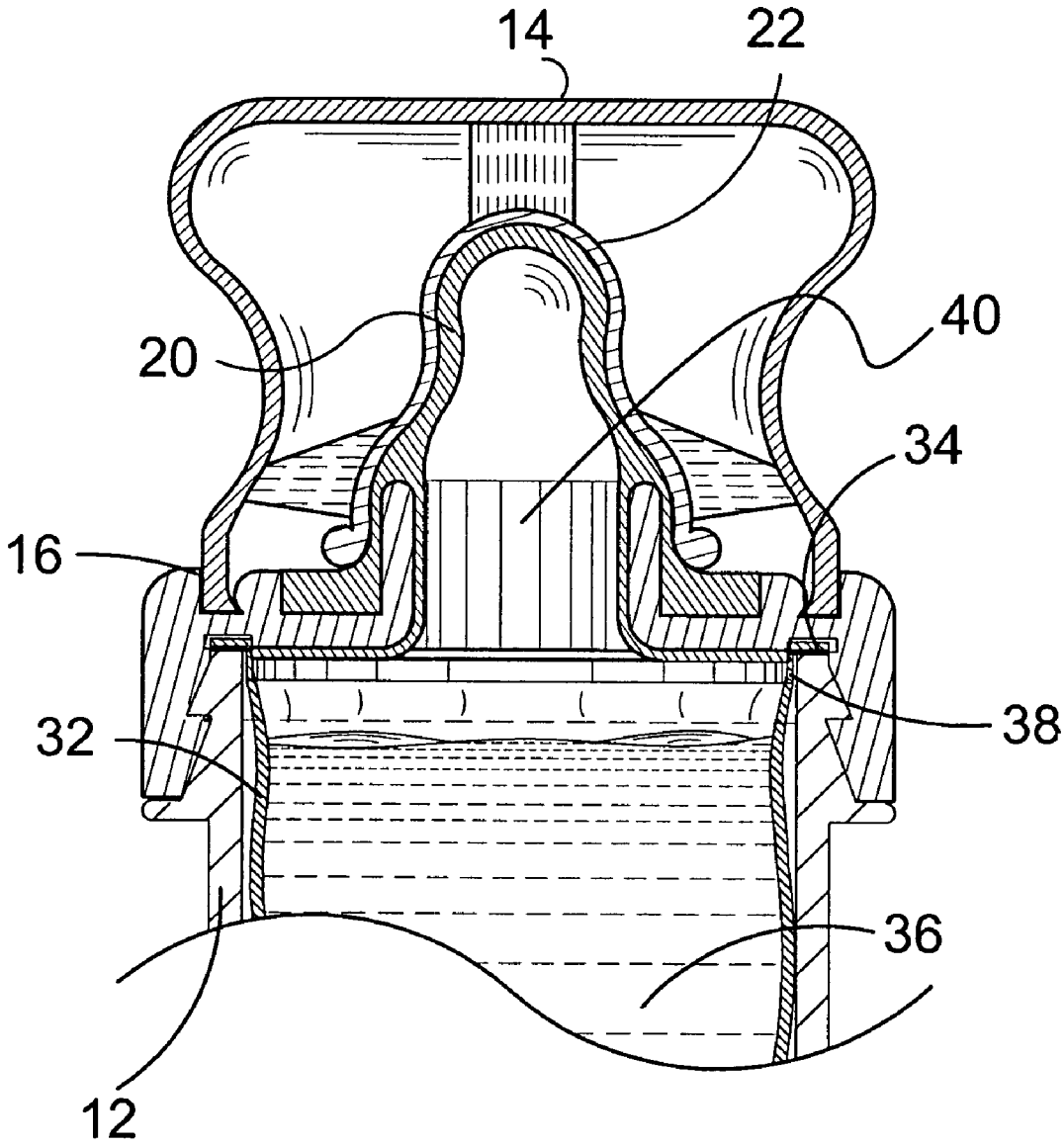
FIG. 12 is a cross-sectional view of the disposable baby bottle of the present invention fully assembled.

FIG. 12 is a cross-sectional view of the disposable baby bottle of the present invention fully assembled. The disposable baby bottle 10 of the present invention includes the bottle portion 12 having an opening 30 at a first end thereof. The bottle portion 12 is able to receive any liquid beverage therein. Alternatively, as will be shown in FIGS. 11 and 12, the bottle portion may receive a liner for retaining a liquid beverage therein. The securing collar 16 is positioned atop the bottle portion 12 at the open end 30 thereof. The securing collar can be pressure fit and or rotatably secured to the open end 30 of the bottle 12. The securing ring has an annular attachment ring 18 positioned on a top side thereof. The annular attachment ring 18 is positioned on a side of the securing ring 16 opposite the connection with the bottle portion 12 of the present invention. The stationary insert 40 ensures the nipple 20 remains upright when force is applied. The annular attachment ring 18 includes a recess 19 for securing a nipple 20 showed therein. The nipple includes a lip 20 which is received within the recess 19 for securing the nipple 20 thereto.

The cap 14 has an inner surface which bonding means 26 as shown in FIG. 4. A compression cap 22 is also positioned with the cap 14. The compression cap 22 has a shape substantially similar to the nipple 20. The compression cap 22 is connected to the cap 14 via the plurality bonding means 26 extending inwardly from the inner surface thereof. The compression cap 22 includes a compression lip 23 for applying a downward force to the lip 21 of the nipple 20 for securing the nipple 20 within the recess 19 of the annular ring 18.

The nipple 20, annular ring 18 and the securing collar 16 form the nipple assembly. The nipple assembly is thus sealed to the bottle 12 when the cap 14 is positioned thereon. The compression cap 22 of the cap 14 is positioned over and around the nipple 20. Upon a applying a downward force on the cap 14, the bonding means cause the compression lip 23 of the compression cap 22 to apply the applied force to the lip 21 of the nipple 20. This applied force causes the nipple 20 to be pressure sealed to the annular ring 18 of the securing ring 16.

Shown herein, is the bottle portion 12 having a liner 32 which is selectively fillable with a beverage 36. The liner 32 has a suspension element 34 which is positioned at an open end thereof. The liner 32 received within the bottle portion 12 of the baby bottle 10 of the present invention. The suspension element 34 securely maintains the liner 32 with the beverage 36 within the bottle portion 12. Thereafter, as discussed above, the securing collar 16 is connected at the open end 30 of the bottle 12 thereby securing the liner 32 within the bottle 12. This allows for the liner to be removed and easily disposed of after the beverage 36 has been consumed.

Shown is the present invention with cap 14 in a fully closed position compressing the nipple 20 therein which will create a compressing force on the beverage substance. The collapsible liner 32 is attached to the suspension element 34. The suspension element 34 is bound between the bottle 12 and a skirt flange 38 by the attachment of the securing collar 16 to the bottle 12. This results in an airtight seal on the suspension element 34.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A baby bottle comprising:

a) a bottle housing having an open end thereof for receiving a liquid therein;

b) a nipple assembly having a securing collar and a nipple attached thereto for positioning at said open end of said bottle housing;

c) a cap having means for compressing said nipple, said compressing means is positioned on an inner surface thereof, wherein upon a downward force being applied to said cap, ad compression means compresses said nipple of said assembly to said securing collar thereby creating an air tight seal between said cap and said nipple assembly for preserving said liquid in said bottle housing;

d) said compressing means comprising a separate compression cap conforming to an outer surface of said nipple mounted within said cap and having a bottom annular flange with a bulbous annular edge forming a compression lip;

e) said nipple having a pair of upper and lower spaced flanges with an L-shaped annular spaced between said spaced flanges, the upper flange forming a ledge; and f) said securing collar having an annular inwardly extending flange with a vertical, annular wall to engage the L-shaped annular space between said upper and lower spaced flanges of said nipple thereby securing said nipple to said collar, said compression lip engaging said ledge of said nipple for compressing said ledge to form said air tight seal.

2. The apparatus as recited in claim 1, further comprising a liner for receipt within said bottle housing for retaining liquid therein.

3. The apparatus as recited in claim 2, further comprising a skirt means extending around an open end of said liner for maintaining said liner in an open position.

4. The apparatus as recited in claim 3, further comprising a suspension means connected at said open end for suspending said liner within said bottle housing, wherein said suspension means rests on a lip of said bottle housing.

5. The apparatus as recited in claim 4, wherein upon said securing collar being positioned on said bottle housing, an air tight seal is formed between said securing collar, said suspension means and said lip of said bottle housing.

6. The apparatus as recited in claim 2, wherein said liner is formed from a pliable material and is collapseable.

7. The apparatus as recited in claim 1, further comprising a circumferential collar-like portion of said cap incorporating a textured finish whereby said cap can be easily removed.

* * * * *